US011725362B2

(12) United States Patent
Bjerke et al.

(10) Patent No.: US 11,725,362 B2
(45) Date of Patent: Aug. 15, 2023

(54) CUTTING EDGE GEOMETRY

(71) Applicant: Caterpillar Inc., Peoria, IL (US)

(72) Inventors: Nathan Bjerke, Peoria, IL (US); Thomas Marshall Congdon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 54 days.

(21) Appl. No.: 16/924,553

(22) Filed: Jul. 9, 2020

(65) Prior Publication Data

US 2020/0340204 A1 Oct. 29, 2020

Related U.S. Application Data

(62) Division of application No. 15/939,692, filed on Mar. 29, 2018, now Pat. No. 10,808,376.

(51) Int. Cl.

| | |
|---|---|
| ***E02F 3/815*** | (2006.01) |
| ***E02F 9/26*** | (2006.01) |
| ***E02F 9/28*** | (2006.01) |

(52) U.S. Cl.

CPC ..... *E02F 3/8152* (2013.01); *E02F 9/26* (2013.01); *E02F 9/2883* (2013.01)

(58) Field of Classification Search

CPC ..... E02F 3/8152; E02F 3/8157; E02F 3/26; E02F 3/2883

See application file for complete search history.

(56) References Cited

U.S. PATENT DOCUMENTS

| | | | | |
|---|---|---|---|---|
| 2,732,639 | A | 1/1956 | Lillengreen | |
| 3,685,177 | A * | 8/1972 | Hahn | E02F 9/2833 37/446 |
| 3,736,664 | A * | 6/1973 | Black | E02F 9/2883 37/446 |
| 3,995,384 | A * | 12/1976 | Wood | E02F 3/40 37/446 |
| 4,269,275 | A | 5/1981 | Cousin | |
| 4,407,081 | A | 10/1983 | Hanson | |
| 4,501,079 | A * | 2/1985 | Hahn | E02F 9/2891 37/450 |
| 4,753,299 | A | 6/1988 | Meyers | |
| 5,224,555 | A * | 7/1993 | Bain | E02F 3/8152 172/701.3 |
| 5,611,157 | A * | 3/1997 | Ferreira | E01H 5/061 172/701.1 |
| 7,874,085 | B1 | 1/2011 | Winter | |
| D824,962 | S | 8/2018 | Winter | |
| 10,167,598 | B2 * | 1/2019 | Stemerman | E01H 5/062 |

(Continued)

FOREIGN PATENT DOCUMENTS

| | | |
|---|---|---|
| CN | 105297825 | 2/2016 |
| CN | 106715804 | 5/2017 |

(Continued)

*Primary Examiner* — Jessica H Lutz

(57) ABSTRACT

A wear member configured to be attached to a work implement includes a body defining a front working region, a rear mounting region, a first side region connecting the front working region to the rear mounting region, and a second side region connecting the front working region to the rear mounting region. The rear mounting region includes a plurality of mounting pads and defines at least once recess disposed at least partially on at least one of the plurality of the mounting pads.

14 Claims, 8 Drawing Sheets

(56) References Cited

U.S. PATENT DOCUMENTS

| | | | | |
|---|---|---|---|---|
| 2011/0232927 | A1* | 9/2011 | Tutschek | E02F 3/8152 172/701.3 |
| 2014/0338933 | A1* | 11/2014 | Harris | E02F 3/7654 172/1 |
| 2014/0373398 | A1* | 12/2014 | Winter | E02F 3/8152 37/266 |
| 2016/0032557 | A1 | 2/2016 | Congdon | |
| 2016/0032558 | A1 | 2/2016 | Congdon | |
| 2016/0032567 | A1 | 2/2016 | Congdon | |
| 2016/0032568 | A1 | 2/2016 | Congdon | |
| 2016/0069041 | A1 | 3/2016 | Winter | |
| 2016/0177543 | A1 | 6/2016 | Bjerke | |
| 2016/0333547 | A1* | 11/2016 | Winter | E01H 5/061 |
| 2017/0191236 | A1* | 7/2017 | Winter | E02F 3/8152 |
| 2018/0038065 | A1* | 2/2018 | Hunt | E02F 9/2841 |
| 2019/0376263 | A1* | 12/2019 | Wood | E02F 3/40 |

FOREIGN PATENT DOCUMENTS

| | | |
|---|---|---|
| CN | 106715805 | 5/2017 |
| CN | 107075831 | 3/2020 |
| WO | 2011127536 A1 | 10/2011 |

* cited by examiner

CUTTING EDGE GEOMETRY

CROSS-REFERENCE TO RELATED APPLICATIONS

This application is a divisional application based upon and claims the benefit of priority of U.S. patent application Ser. No. 15/939,692 filed on Mar. 29, 2018 with the same title, the contents of which are hereby incorporated by reference in its entirety.

TECHNICAL FIELD

The present disclosure relates to the field of machines that perform work on a material using work implements such as mining, construction and earth moving machines and the like. Specifically, the present disclosure relates to work implements such as blade that use replaceable wear members such as cutting edges including end bits and intermediate bits.

BACKGROUND

During normal use on machines such as mining, construction, and earthmoving machines and the like, work implements such as blades have edges that experience wear. It is not uncommon for these edges to be protected by various types of wear members. These wear members are intended to be sacrificial, protecting the edges of the blade so that the more expensive blade or other type of work implement does not need to be replaced. It is desirable that these wear members be replaced before damage or wear occurs on the working edges of the work implement. So, many wear members have wear indicators to warn the user when the wear member needs to be replaced. However, these wear indicators may not be conspicuous or may negatively impact the work performance of the wear member. That is to say, the wear indicator may weaken or reduce the effectiveness or life of the wear member.

Furthermore, wear members are often cast and may experience problems when being cast. For example, the more complex the geometry of the wear member, the more difficult it is to manufacture the wear member via the casting process without having porosity or voids be introduced in the interior of the wear member. This may lead to premature cracking and replacement of the wear member.

Accordingly, it is desirable to develop a wear member that can be manufactured with more complex geometry without risking manufacturing problems and/or to provide a wear member that indicates its useful life expectancy without having reducing the working effectiveness of the wear member.

SUMMARY OF THE DISCLOSURE

A wear member configured to be attached to a work implement according to an embodiment of the present disclosure is provided. The wear member comprises a body defining a front working region, a rear mounting region, a first side region connecting the front working region to the rear mounting region, and a second side region connecting the front working region to the rear mounting region. The rear mounting region includes a shelf forming a bottom surface and a rear surface.

A wear member configured to be attached to a work implement according to another embodiment of the present disclosure is provided. The wear member comprises a body defining a front working region, a rear mounting region, a first side region connecting the front working region to the rear mounting region, and a second side region connecting the front working region to the rear mounting region. The rear mounting region includes a plurality of mounting pads and defines at least once recess disposed at least partially on at least one of the plurality of the mounting pads.

A wear member configured to be attached to a work implement according to an embodiment of the present disclosure is provided. The wear member may comprise a body defining a front working region, a rear mounting region, a first side region connecting the front working region to the rear mounting region, and a second side region connecting the front working region to the rear mounting region. The rear mounting region includes a shelf forming a bottom surface and a rear surface and the first side region defines a wear indicator.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Figure 1:
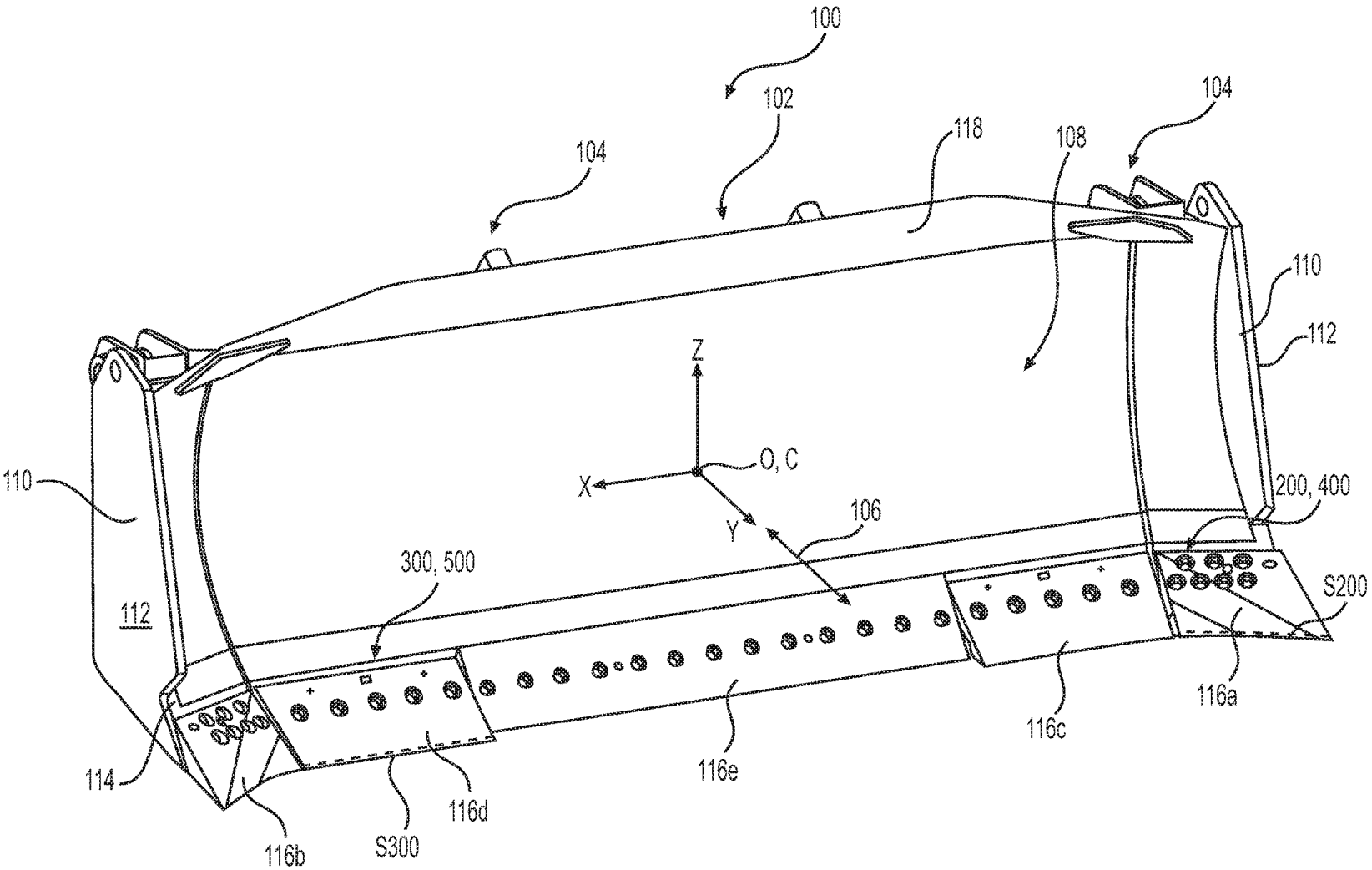
FIG. 1 is a perspective view of a work implement in the form of a blade assembly that uses wear members according to various embodiments of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100a, 100b or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

Various embodiments of a wear member such as a cutting edge include end bits, intermediate bits, and center bit configured to be attached to a working edge such as a lip of a work implement such as a blade will be described.

Figure 2:
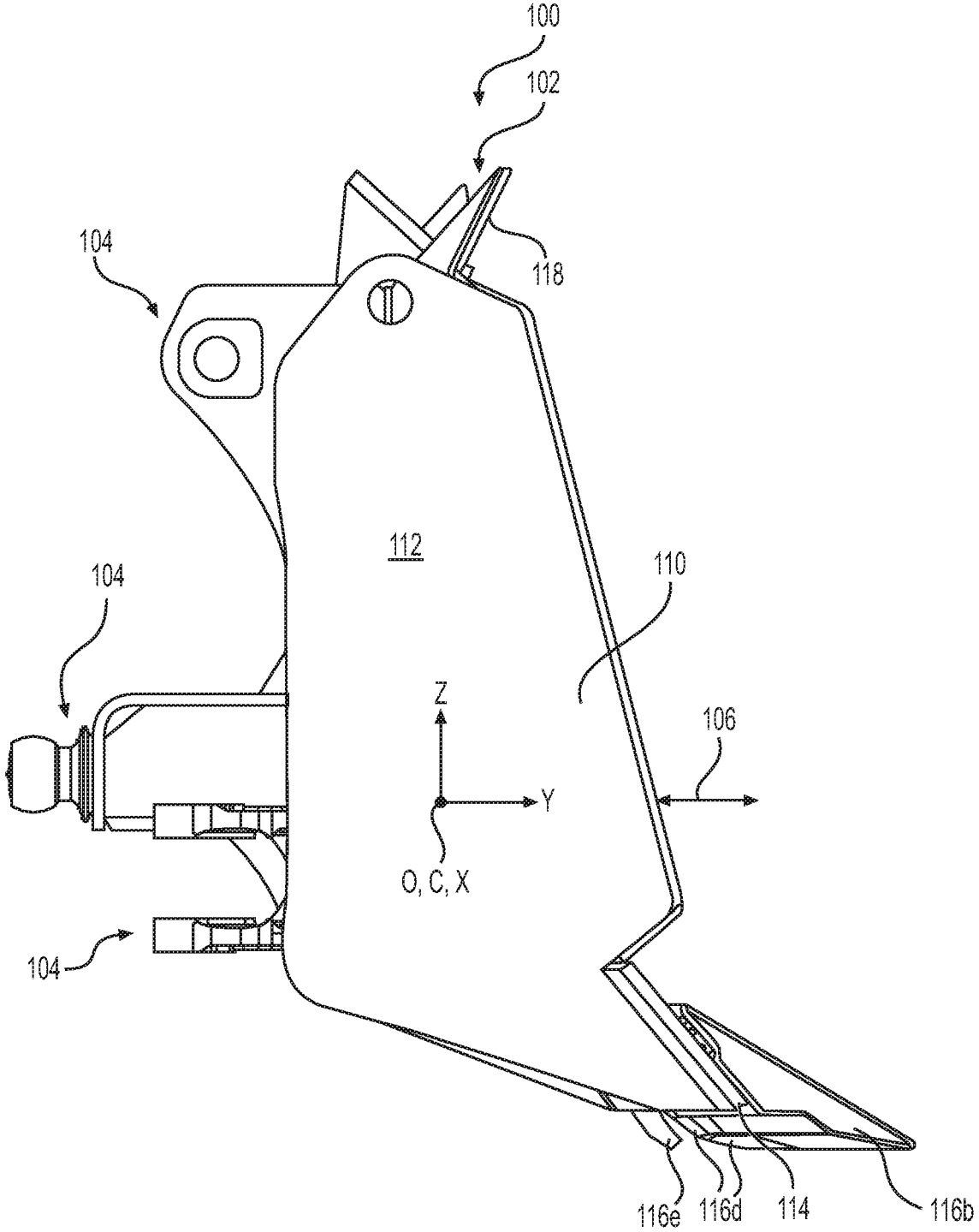
FIG. 2 is a side view of the blade assembly of FIG. 1, showing the profile of a wear member according to a first embodiment of the present disclosure that includes an end bit.

Looking at FIGS. 1 and 2, a work implement 100 such as a blade 102 is shown. While various embodiments will be disclosed that are particularly adapted to work with a blade 102, it is to be understood that embodiments of the present disclosure may be used with other work implements 100 such as rakes, shears, bucket assemblies, etc. For reference, a Cartesian coordinate system X, Y, Z with its origin O is placed at the center of mass C (centroid) of the work implement 100. The Y-axis is oriented in a direction perpendicular to the mounting structure 104 of the blade 102, mimicking the traveling direction or working direction 106 that the blade 102 moves when the machine using such a blade 102 moves. This working direction 106 may be horizontal in many applications. The Z-axis is oriented in a purely vertical direction. The X-axis establishes the lateral or transverse direction.

The blade 102 includes an interior curved shell region 108, side plates 110 defining side surfaces 112, mounting structure 106 for attaching the blade 102 to a machine such a bull dozer, a top spill guard 118, and a front lip 114. A plurality of wear members 200 are shown attached to the front lip 114 of the blade 102. The wear member 116 include end bits 116*a*, 116*b*, two intermediate bits 116*c*, 116*d*, and a center bit 116*e*. These wear members 116 provide cutting edge geometry, allowing the blade 102 to dig into the earth or other work material and sacrificially wear while protecting the front lip 114 of the blade 102. The two end bits 116*a*, 116*b* and the two intermediate bits 116*c*, 116*d* are symmetrical about the Y-Z plane, forming a right end bit 116*a*, a left end bit 116*b*, a right intermediate bit 116*c*, and a left intermediate bit 116*d*. A center bit 116*e* that may or may not have similar features as will now be described with reference to FIGS. 2 thru 8 may also be provided.

Figure 3:
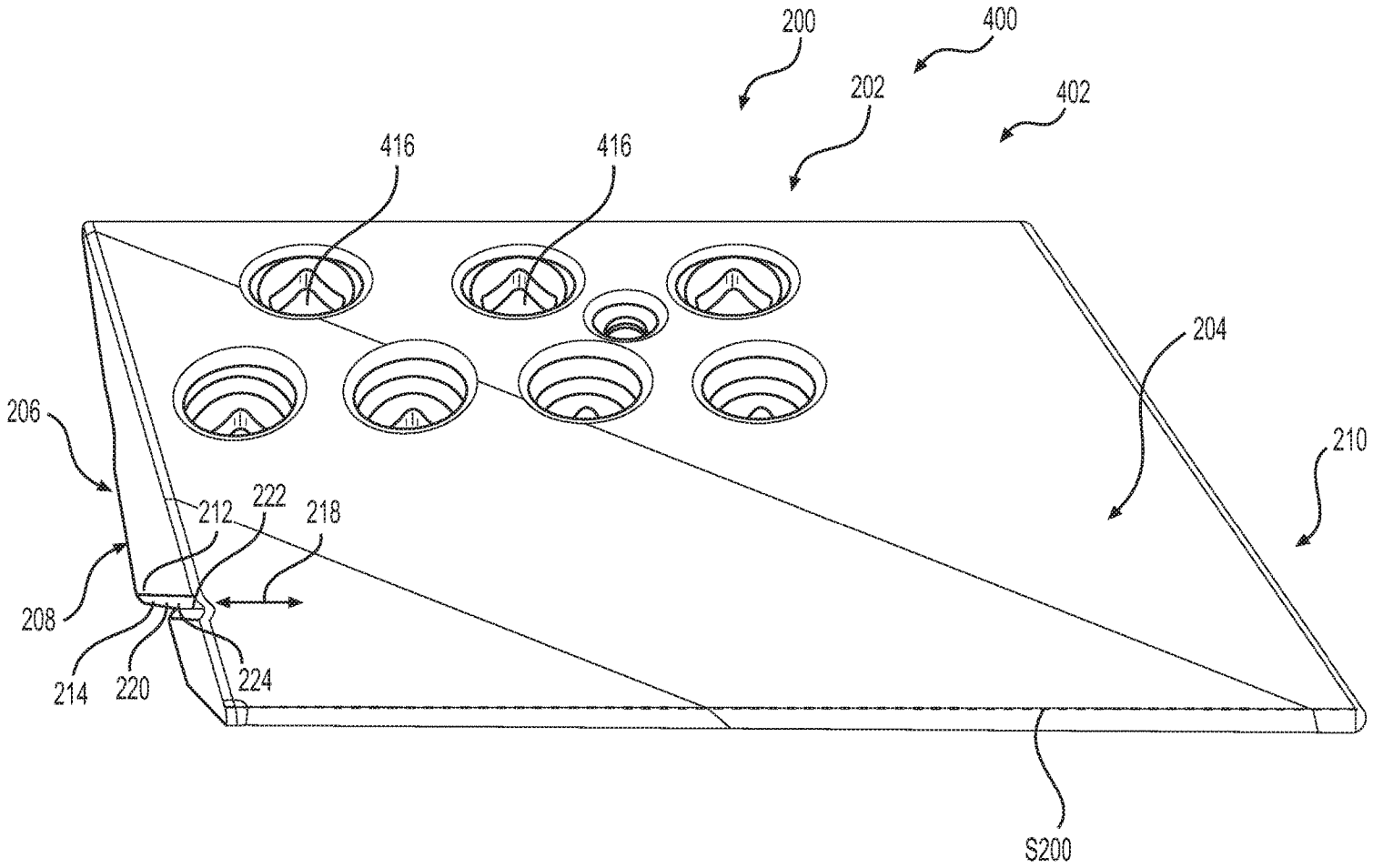
FIG. 3 is a front view of the end bit of FIG. 2 shown in isolation from the blade assembly.
Figure 4:
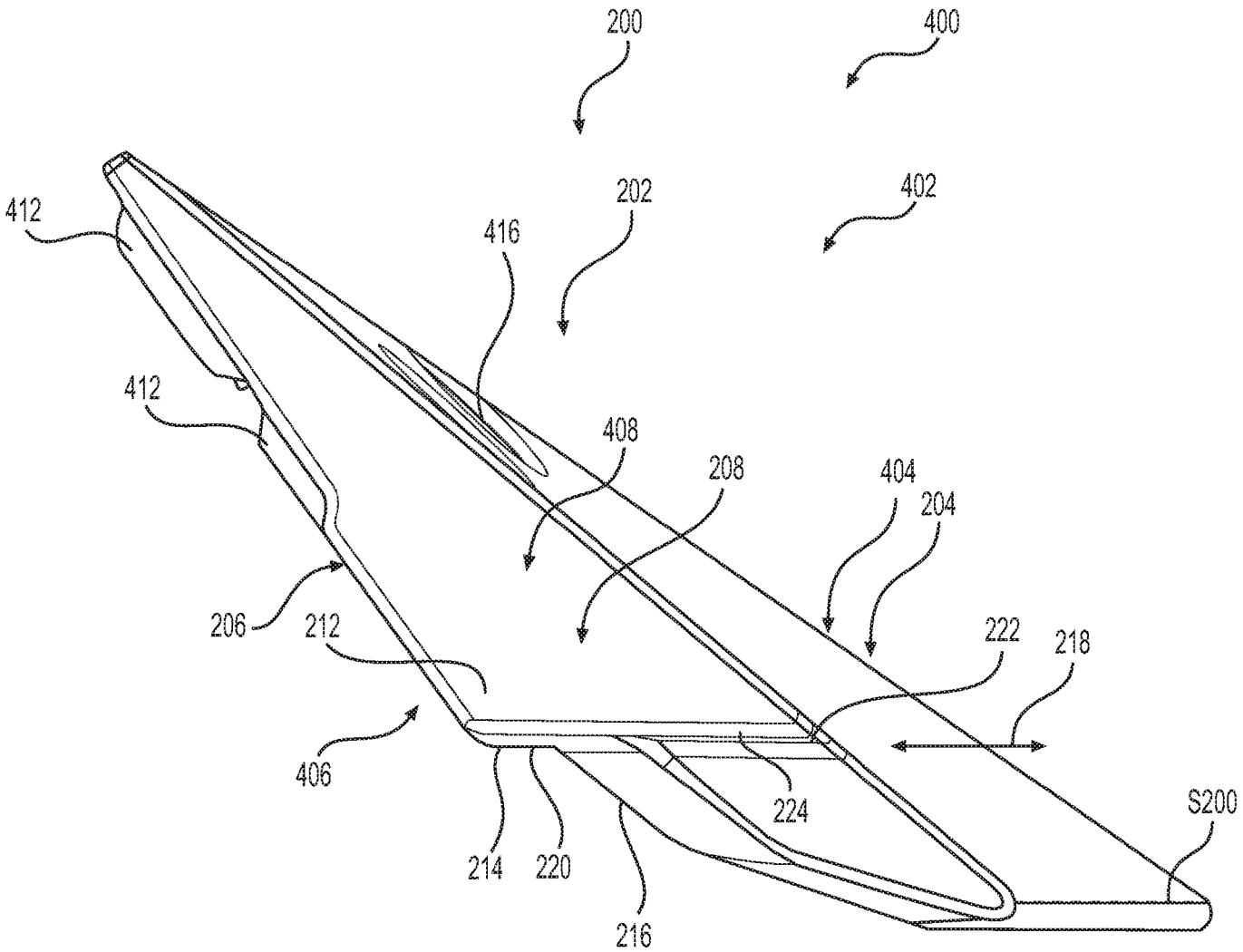
FIG. 4 is a side view of the end bit of FIG. 3.
Figure 5:
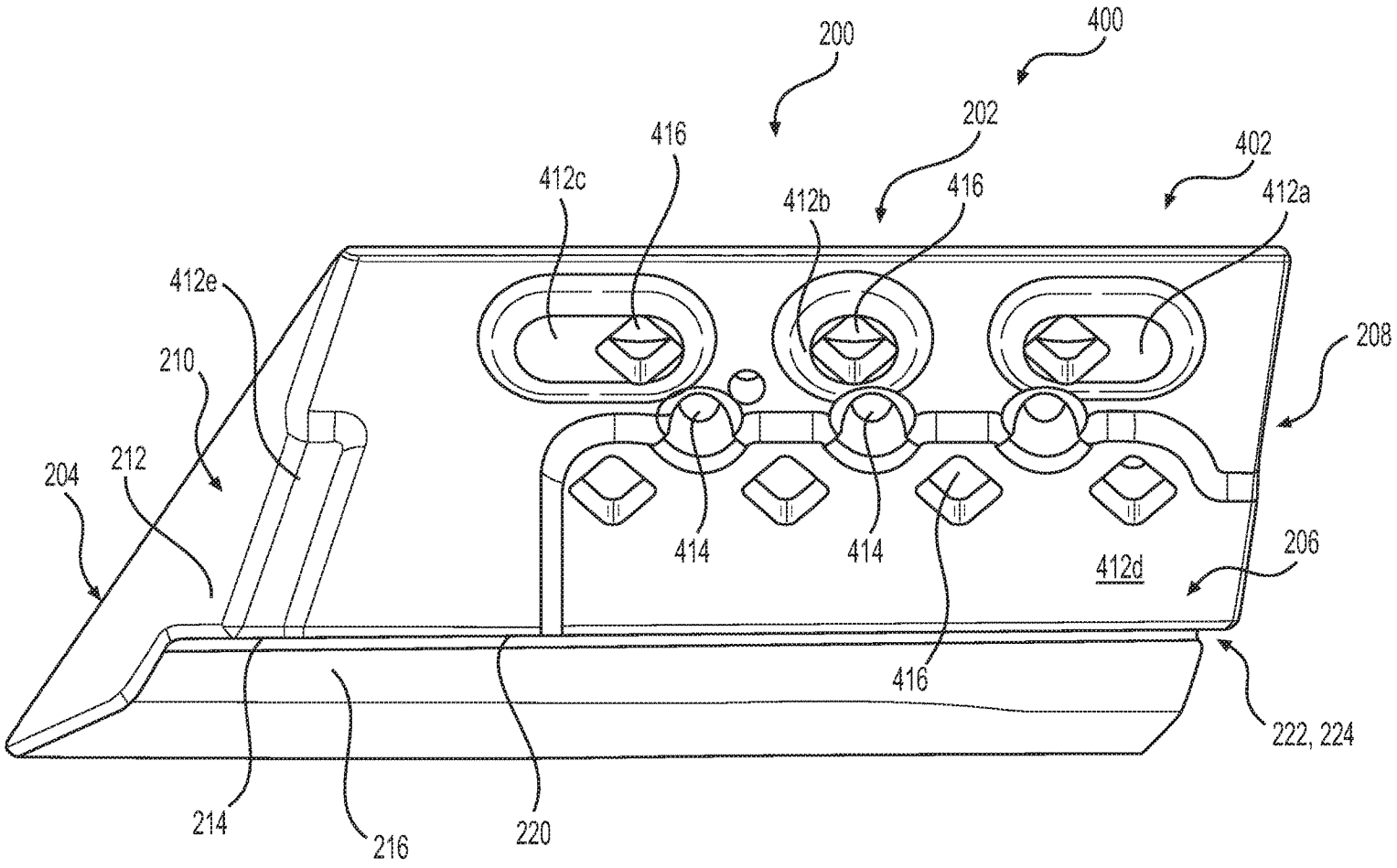
FIG. 5 is a rear view of the end bit of FIG. 4.

Referring now to FIGS. 3 thru 5, a wear member 200 in the form of a right end bit 116*a* (as viewed in FIG. 1) that is configured to be attached to a work implement 100 such as a blade 102 is disclosed. The wear member 200 may be suited to be attached to the front lip 114 of a blade 102 in a secure manner and to indicate when the wear member needs to be replaced in a reliable manner without affecting the working performance of the wear member 200. The wear member 200 may comprise a body 202 defining a front working region 204, a rear mounting region 206, a first side region 208 connecting the front working region 204 to the rear mounting region 206, and a second side region 210 connecting the front working region 204 to the rear mounting region 206. The rear mounting region 206 may include a shelf 212 forming a bottom surface 214 and a rear surface 216. The bottom surface 214 and the rear surface 216 may form an oblique angle with each other as shown in FIGS. 3 thru 5 or may be perpendicular to each other in other embodiments.

Also, the wear member 200 defines a working direction 218 (parallel to working direction 106 shown in FIG. 1) and the first side region 208 includes a wear indicator 218 that extends along a direction parallel to the working direction 218 or in a horizontal plane (a X-Y plane such as shown in FIG. 1). Likewise, the bottom surface 214 includes a planar shelf face 220 that extends along the working direction 218. That is to say, the resting surface 214 is in a horizontal plane (an X-Y plane). Consequently, the planar shelf face 220 is parallel to the wear indicator 222 or coplanar therewith. This may not be the case in other embodiments. The wear indicator 222 may be a groove 224 or a protrusion, etc.

As best understood with reference to FIG. 1, the body 202 of the wear member 200 defines a sweep path S200 that is at least partially transverse to the working direction 218, 106. The sweep path S200 is not a straight line, but curves away from the transverse direction (X direction), at least partially forming an oblique angle therewith. This may not be the case for other embodiments. Hence, an end bit 116*a* is formed.

For this embodiment, the first side region 208 may be configured at an angle to the vertical direction (Z direction) to match the adjacent side region of an intermediate bit 116*c* and the second side region 210 may configured to be vertical to match the side surface 112 of a work implement 100 such as a blade 102. The side regions 208, 210 may be differently configured in other embodiments.

Figure 6:
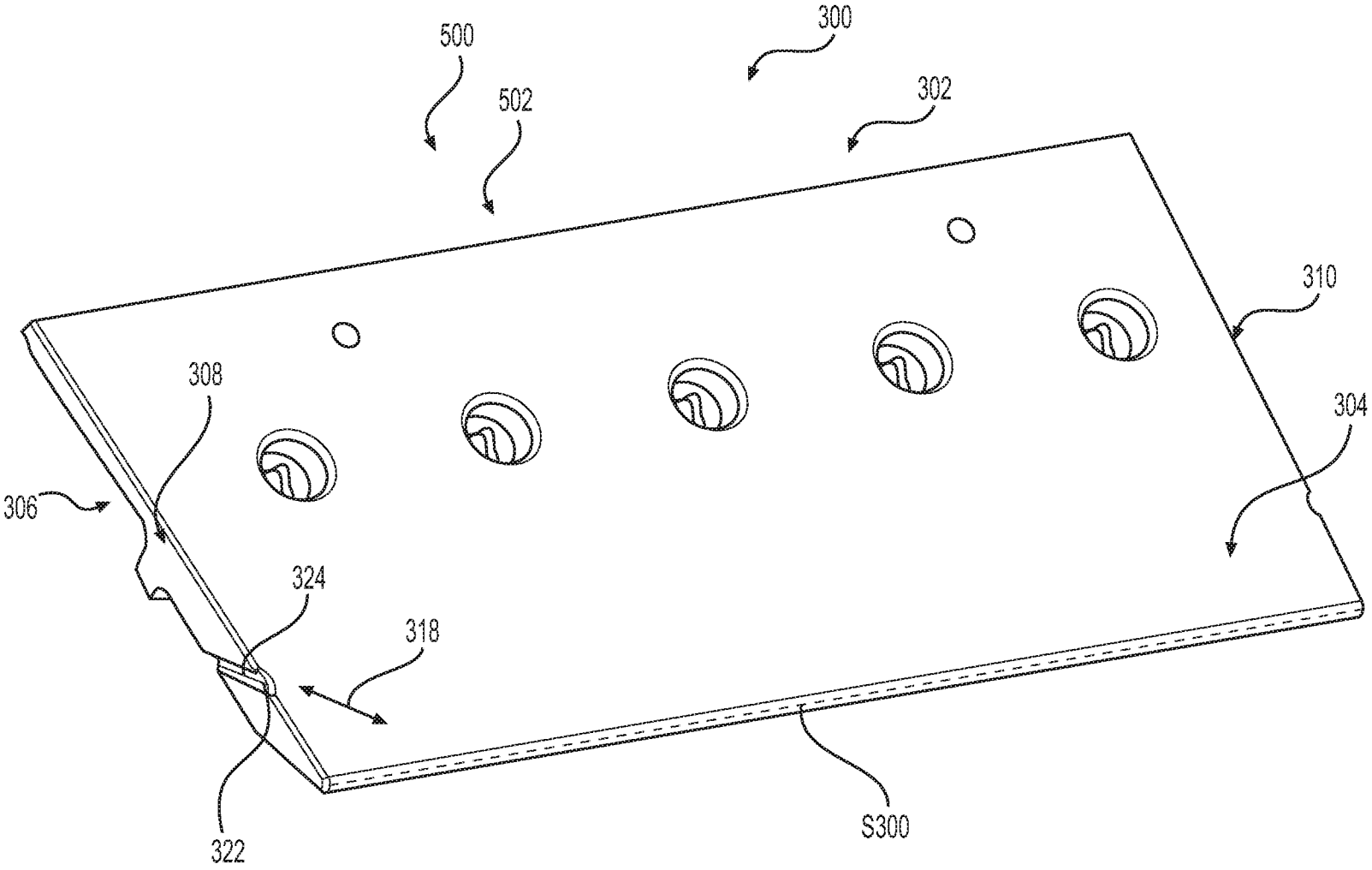
FIG. 6 is a perspective view of a wear member according to a second embodiment of the present disclosure that includes an intermediate bit that is used with the blade assembly of FIG. 1, shown in isolation.
Figure 7:
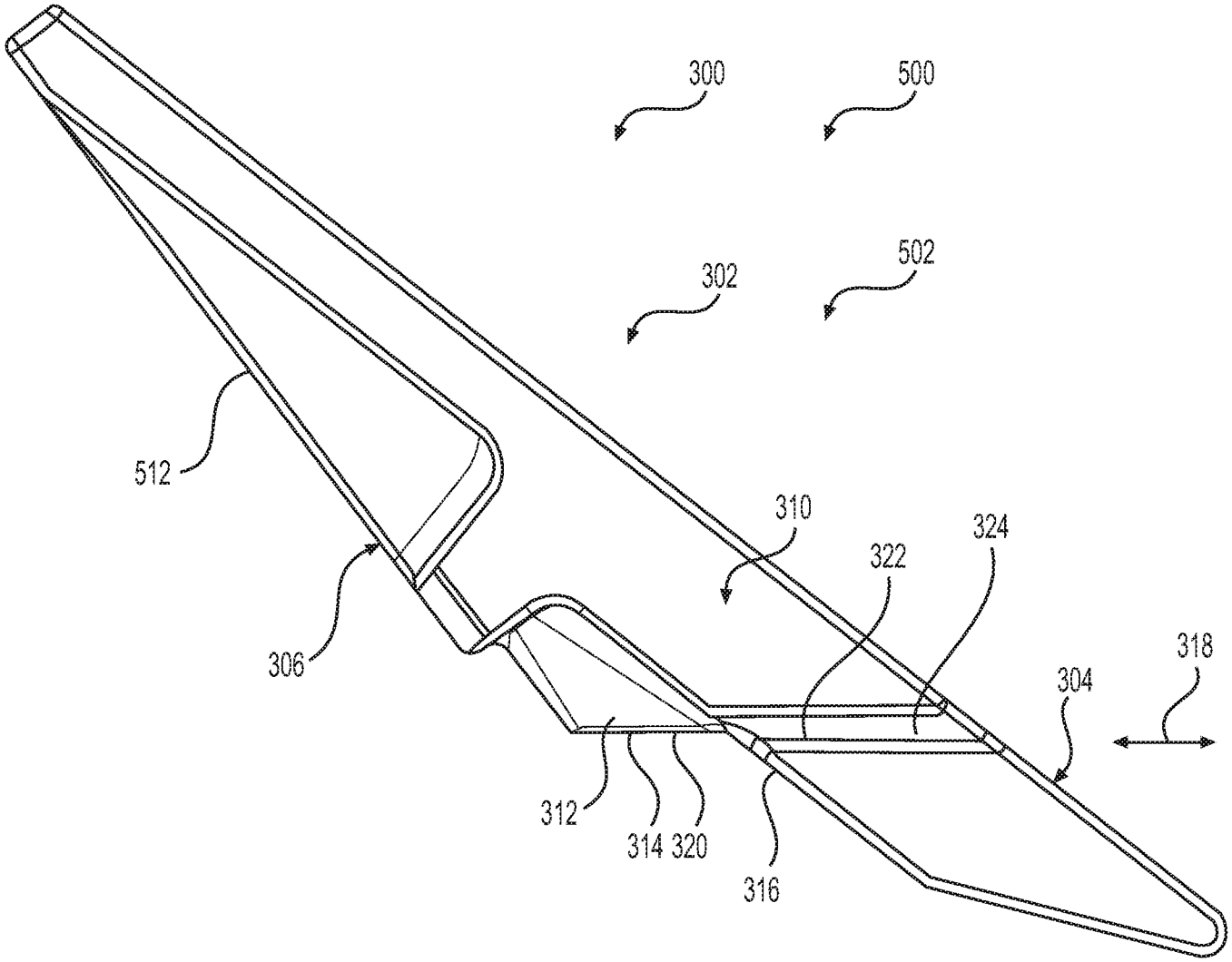
FIG. 7 is a side view of the intermediate bit of FIG. 6.
Figure 8:
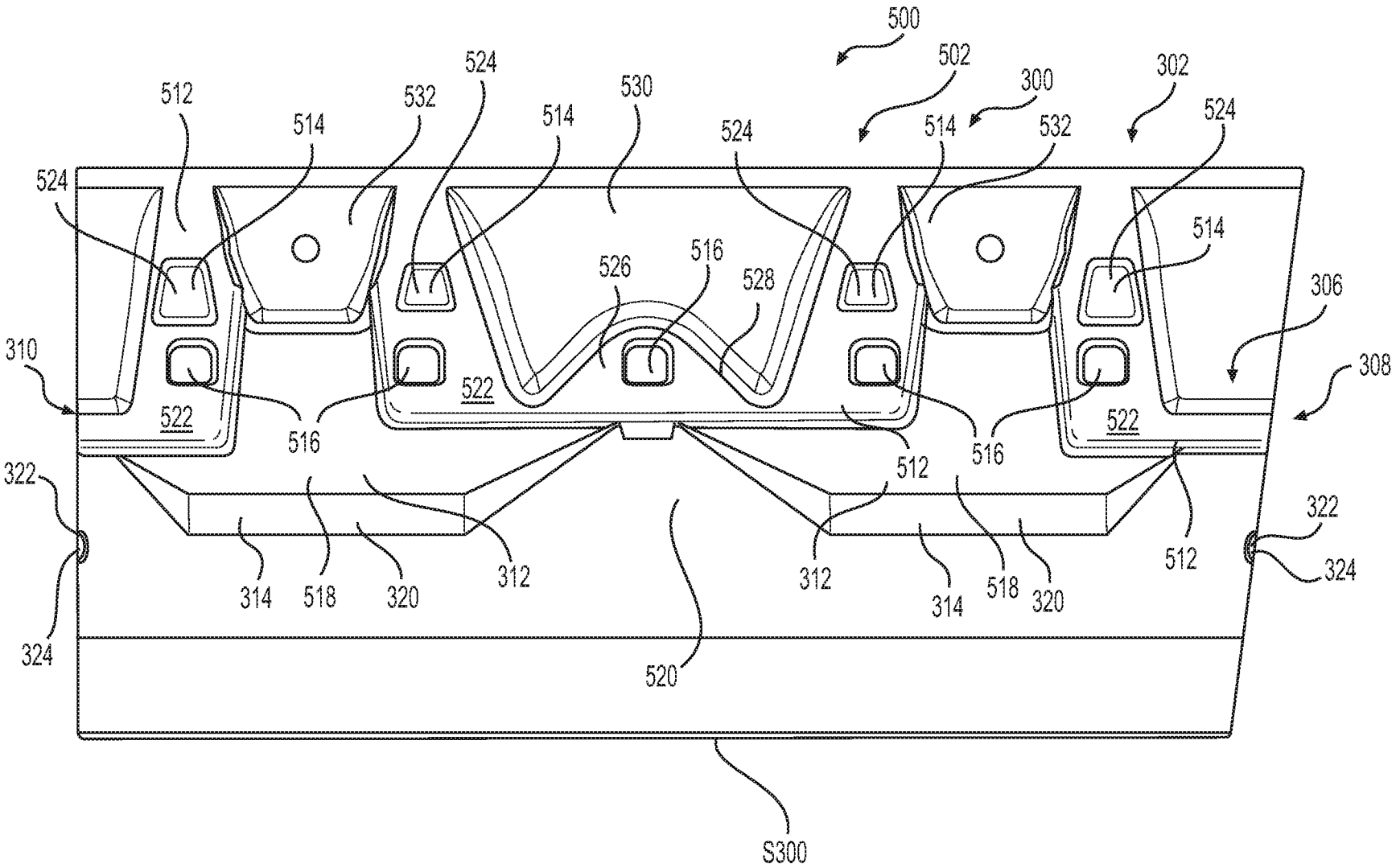
FIG. 8 is a rear view of the intermediate bit of FIG. 7.

Referring now to FIGS. 6 thru 8, a wear member 300 in the form of a left intermediate bit 116*d* (as viewed in FIG. 1) that is configured to be attached to a work implement 100 such as a blade 102 is disclosed. The wear member 300 may comprise a body 302 defining a front working region 304, a rear mounting region 306, a first side region 308 connecting the front working region 304 to the rear mounting region 306, and a second side region 310 connecting the front working region 304 to the rear mounting region 306. The rear mounting region 306 may include a shelf 312 forming a bottom surface 314 and a rear surface 316. The bottom surface 314 and the rear surface 316 may form an oblique angle with each other as shown in FIGS. 6 thru 8 or may be perpendicular to each other in other embodiments.

Also, the wear member 300 defines a working direction 318 (parallel to working direction 106 shown in FIG. 1) and the first side region 308 includes a wear indicator 318 that extends along a direction parallel to the working direction 318 or in a horizontal plane (a X-Y plane such as shown in FIG. 1). Likewise, the bottom surface 314 includes a planar shelf face 320 that extends along the working direction 318. That is to say, the bottom surface 314 is in a horizontal plane (an X-Y plane). Consequently, the planar shelf face 320 is parallel to the wear indicator 322. This may not be the case in other embodiments. The wear indicator 322 may be a groove 324 or a protrusion, etc.

As best understood with reference to FIG. 1, the body 302 of the wear member 300 defines a sweep path S300 that is at least partially transverse to the working direction 318, 106. The sweep path S300 is a straight line. Hence, an intermediate bit 116*d* is formed.

For this embodiment, the first side region 308 may be configured at an angle to the vertical direction (Z direction) to match the adjacent side region of an end bit 116*b* and the second side region 310 may configured to be vertical to match the side surface 112 of a work implement 100 such as a blade 102. The side regions 308, 310 may be differently configured in other embodiments.

Referring back to FIGS. 3 thru 5, another wear member 400 is disclosed that is constructed to facilitate the casting process. The wear member 400 may comprise a body 402 defining a front working region 404, a rear mounting region 406, a first side region 408 connecting the front working region 404 to the rear mounting region 406, and a second side region 410 connecting the front working region 404 to the rear mounting region 406. The rear mounting region 406 may include a plurality of mounting pads 412 and may define at least one recess 414 disposed at least partially on at least one of the plurality of the mounting pads 412. In many embodiments, a plurality of recesses 414 are provided.

More particularly, the wear member 400 defines a plurality of mounting apertures 416 extending completely through the body 402 and that are disposed at least partially on at least one of the mounting pads 412. As best seen in FIG. 5, a plurality of three top mounting pads 412*a*, 412*b*, 412*c* are provided with mounting apertures 414 extending through the body 402. The three top mounting pads 412*a*, 412*b*, 412*c* may have circular or oval shapes. Two bottom mounting pads 412*d,* 412*e* having a generally rectangular profile are also provided. One of the bottom mounting pads 412*d* has a plurality of mounting apertures 416 extending through the body 402.

The recesses 414 may help to maintain a consistent wall thickness, possibly avoiding thick sections prone to voids or porosity that may occur during the casting process.

Focusing on FIG. 8, another wear member 500 similarly constructed to wear member 400 with similar attributes will be described. The wear member 500 includes a plurality of mounting pads 512 and defines at least one mounting aperture 516 extending completely through the body 502.

The wear member 500 may comprise at least a first shelf portion 518*a* disposed underneath at least one of the mounting pads 512. For this particular embodiment, two mounting shelf portions 518*a,* 518*b* are provided, separated by a V-shaped notch 520, and the plurality of mounting pads 512*a,* 512*b,* 512*c* extend rearward from the two shelf portions 518*a,* 518*b*.

The mounting pad 512 defines a rear planar face 522 and at least a first blind pocket 524 disposed on the rear planar face 522 adjacent at least one of the plurality of the mounting apertures 516 that extends completely through the body 502.

At least one of the mounting pads 512 may include an upper portion 526 defining an upper perimeter 528, forming an upper pocket 530. The upper perimeter 528 at least partially matches the V-shaped notch 520. In particular the upper perimeter 528 may form at least partially a "W" configuration.

The body may further define a separating pocket 532 disposed between each of the mounting pads 514. The separating pocket 532 and the upper pocket 530 may help to reduce the weight of the wear member 500.

As shown in FIG. 8, the first blind pocket 524 may define a trapezoidal perimeter. A plurality of such configured blind pockets 524 may be provided. The blind pockets 524 may help to maintain a consistent wall thickness of the body, helping to avoid voids or porosity during the casting process.

In some embodiments, a wear member that has both sets of features may be provided, helping to provide a wear member that indicates to the user that the wear member needs to be replaced while also not affecting the working performance of the wear member, and to help avoid manufacturing problems.

Referring to FIGS. 3 thru 8, the wear member 200, 300, 400, 500 may comprise a body 202, 302, 402, 502 defining a front working region 204, 304, 404, 504, a rear mounting region 206, 306, 406, 506, a first side region 208, 308, 408, 508 connecting the front working region 204, 304, 404, 504 to the rear mounting region 206, 306, 406, 506, and a second side region 210, 310, 410, 510 connecting the front working region 204, 304, 404, 504 to the rear mounting region 206, 306, 406, 506. The rear mounting region 206, 306, 406, 506 includes a shelf 212, 312, forming a bottom surface 214, 314, and a rear surface 216, 316 and the first side region 208, 308, 408, 508 defines a wear indicator 222, 322.

Moreover, the body 202, 302, 402, 502 defines a working direction 218, 318, and the bottom surface 214, 314 is parallel to the working direction 218, 318 and the wear indicator 222, 322 extends parallel to the working direction 218, 318. The bottom surface 214, 314 is a planar shelf face 220, 320 and the wear indicator 222, 322 is a groove 224, 324.

Any of the surfaces or features described herein may have any suitable shape including flat, arcuate, etc. The term "arcuate" includes any bowed shape including polynomial, sinusoidal, spline, radial, elliptical, etc. Similarly, any blend or transitional surface may include any of these arcuate shapes or may be flat, etc.

Furthermore, as used herein, the terms "upper", "lower", "top", "bottom", "rear", "rearward", "forward", "forwardly", etc. are to be interpreted relative to the direction of assembly of the component onto a front lip of a blade or the like but also includes functional equivalents when the components are used in other scenarios. In such cases, these terms including "upper" may be interpreted as "first" and "lower" as "second", etc. Reference to a Cartesian coordinate system will also be made. Such coordinate systems inherently define an X-axis, Y-axis, and Z-axis as well as corresponding X-Y, X-Z, and Y-Z planes.

The configuration of any embodiment of a wear member of the present disclosure, as well as associated features, dimensions, angles, surface areas, and ratios may be adjusted as needed or desired.

INDUSTRIAL APPLICABILITY

In practice, a work implement such as a blade may be sold with one or more wear members according to any of the embodiments discussed herein. In other situations, a kit that includes components for retrofitting an existing work implement or a newly bought work implement with one or more wear members may be provided. It is further contemplated that a wear member may be provided separately or in any combination with other wear members.

Economic endeavors such as mining operations may require that a work implement be used under harsh conditions and the severity of the operation conditions may be ascertained when wear members are frequently needed to be repaired or replaced. If so, then the user or the entity conducting the operation may opt to purchase or otherwise obtain work implements using wear members as described herein. Alternatively, the individual wear members may be individually procured.

Other entities may provide, manufacture, sell, retrofit or otherwise obtain work implements having the wear members according to any embodiment discussed herein or may provide, manufacture, sell, refurbish, remanufacture, or otherwise obtain wear members individually or in any suitable combination, etc.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. Also, the numbers recited are also part of the range.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps or combined. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A wear member configured to be attached to a work implement, the wear member comprising:

a body defining a front working region, a rear mounting region, a bottom surface connecting the front working region to the rear mounting region, a first side region connecting the front working region to the rear mounting region, and a second side region connecting the front working region to the rear mounting region, wherein the rear mounting region includes a plurality of mounting pads and defines at least one recess disposed at least partially on at least one of the plurality of the mounting pads, and the rear mounting region lacks a forked portion, a plurality of mounting apertures extending completely through the body from the front working region to the rear mounting region, and that are disposed at least partially on at least one of the plurality of mounting pads, and each of the mounting pads includes a rear planar surface, and the front working region includes a front planar surface that forms an acute angle with the rear planar surface of each of the mounting pads;

at least a first shelf portion disposed underneath at least one of the mounting pads; and two shelf portions, separated by a V-shaped notch, and the plurality of mounting pads extend rearward from the two shelf portions.

2. The wear member of claim 1, wherein the mounting pad defines a rear planar face and the at least one recess is a first blind pocket disposed on the rear planar face adjacent at least one of the plurality of the mounting apertures that extends completely through the body.

3. The wear member of claim 2, wherein at least one of the mounting pads includes an upper portion defining an upper perimeter, forming an upper pocket.

4. The wear member of claim 3, wherein the upper perimeter at least partially forms a "W" configuration.

5. The wear member of claim 4, wherein the body further defines a separating pocket disposed between each of the mounting pads.

6. The wear member of claim 2, wherein the first blind pocket defines a trapezoidal perimeter.

7. A wear member configured to be attached to a work implement, the wear member comprising:

a body defining a front working region, a rear mounting region, a bottom surface connecting the front working region to the rear mounting region, a first side region connecting the front working region to the rear mounting region, and a second side region connecting the front working region to the rear mounting region;

wherein the rear mounting region includes a plurality of mounting pads and defines at least one recess disposed at least partially on at least one of the plurality of the mounting pads, and further includes two shelf portions, separated by a V-shaped notch, and the plurality of mounting pads extend rearward from the two shelf portions.

8. The wear member of claim 7, wherein the two shelf portions extend to a level underneath the plurality of mounting pads.

9. The wear member of claim 7, wherein the wear member defines a plurality of mounting apertures extending completely through the body from the front working region to the rear mounting region, and that are disposed at least partially on at least one of the plurality of mounting pads.

10. The wear member of claim 9, wherein at least one of the plurality of mounting pads defines a rear planar face and the at least one recess is a first blind pocket disposed on the rear planar face adjacent at least one of the plurality of the mounting apertures that extends completely through the body.

11. The wear member of claim 9, wherein at least one of the plurality of mounting pads includes an upper portion defining an upper perimeter, forming an upper pocket.

12. The wear member of claim 11, wherein the upper perimeter at least partially forms a "W" configuration.

13. The wear member of claim 12, wherein the body further defines a separating pocket disposed between each of the plurality of mounting pads.

14. The wear member of claim 10, wherein the first blind pocket defines a trapezoidal perimeter.

* * * * *